US012370423B2

(12) United States Patent
Sikaste

(10) Patent No.: US 12,370,423 B2
(45) Date of Patent: Jul. 29, 2025

(54) GOLF TEE AID

(71) Applicant: T-Time Golf OÜ, Harju maakond (EE)

(72) Inventor: Kristjan Sikaste, Harju maakond (EE)

(73) Assignee: T-Time Golf OÜ, Kiili vald (EE)

( * ) Notice: Subject to any disclaimer, the term of this patent is extended or adjusted under 35 U.S.C. 154(b) by 11 days.

(21) Appl. No.: 18/541,648

(22) Filed: Dec. 15, 2023

(65) Prior Publication Data

US 2024/0198196 A1 Jun. 20, 2024

(30) Foreign Application Priority Data

Dec. 17, 2022 (EE) ..... U202200042

(51) Int. Cl.
*A63B 57/12* (2015.01)

(52) U.S. Cl.
CPC ..... *A63B 57/12* (2015.10); *A63B 2209/10* (2013.01)

(58) Field of Classification Search
CPC ..... A63B 57/12; A63B 2009/10; A63B 57/10
See application file for complete search history.

(56) References Cited

U.S. PATENT DOCUMENTS 1,589,494 A * 6/1926 Ward ..... A63B 57/12 473/394
2,159,893 A * 5/1939 Hansen ..... A63B 57/10 473/393
4,114,878 A * 9/1978 Hammond ..... A63B 57/12 473/394
4,336,940 A * 6/1982 Sprague ..... A63B 57/10 473/396
5,211,395 A * 5/1993 Liao ..... A63B 57/207 473/391

(Continued)

FOREIGN PATENT DOCUMENTS

DE 20314958 U1 * 2/2004 ..... A63B 57/10
DE 202020001927 U1 * 9/2020

(Continued)

OTHER PUBLICATIONS

Search Report of Estonian Priority Utility Model No. U202200042, dated Jun. 21, 2023.

(Continued)

*Primary Examiner* — Steven B Wong
(74) *Attorney, Agent, or Firm* — Koivula & Somersalo, LLC

(57) ABSTRACT

The invention relates to a golf tee aid, which limits the flight range of the golf tee from the player after making the strike. For this purpose, a connector is provided, which is an elastic cord with an attachment loop in one end and two elastic loops—an anchoring loop and a loop for a thickening—at the other end of the connector, and a thickening at the end of the connector. The anchoring loop is intended for inserting the tee used for anchoring and applying it as an anchoring aid that is pushed into the ground. The thickening together with the loop for the thickening form a fastening device for the removable fastening aid. The removable fastening aid is intended for fastening the connector to a separate anchoring aid, which bears a load. The aid can be used with tees of different lengths and thicknesses.

3 Claims, 1 Drawing Sheet

(56) References Cited

U.S. PATENT DOCUMENTS

| | | | | | |
|---|---|---|---|---|---|
| 5,221,090 | A * | 6/1993 | Hong | A63B 57/12 | 473/390 |
| 5,413,348 | A * | 5/1995 | Basso | A63B 57/10 | 473/396 |
| 7,645,202 | B2 * | 1/2010 | Lee | A63B 57/12 | 473/396 |
| 10,124,223 | B1 * | 11/2018 | Porter | A63B 57/12 | |
| 11,617,930 | B1 * | 4/2023 | Johnson | A63B 57/12 | 473/387 |
| 2002/0094887 | A1 | 7/2002 | Echaves | | |
| 2008/0039238 | A1 * | 2/2008 | Lee | A63B 57/15 | 473/400 |
| 2013/0005511 | A1 | 1/2013 | Murphy | | |
| 2014/0162810 | A1 * | 6/2014 | Park | A63B 57/353 | 473/391 |
| 2015/0314178 | A1 | 11/2015 | Cloutier | | |
| 2020/0230474 | A1 | 7/2020 | Evans | | |

FOREIGN PATENT DOCUMENTS

| | | | | | |
|---|---|---|---|---|---|
| GB | 2411123 | A | 8/2005 | | |
| GB | 2465342 | A | 5/2010 | | |
| KR | 200407788 | Y1 * | 2/2006 | | |
| KR | 100869159 | B1 * | 11/2008 | | |
| KR | 101415055 | B1 * | 7/2014 | | |
| KR | 200498255 | Y1 * | 8/2024 | | |
| WO | WO-2009075498 | A2 * | 6/2009 | | A63B 57/10 |

OTHER PUBLICATIONS

Por Miguel Angel Buil, Tee Caddy—A great invention for never losing your tee again!, Jan. 30, 2015, retrieved online on Dec. 15, 2023 at <https://mygolfway.com/en/tee-caddy-great-invention-never-losing-tee/>.

* cited by examiner

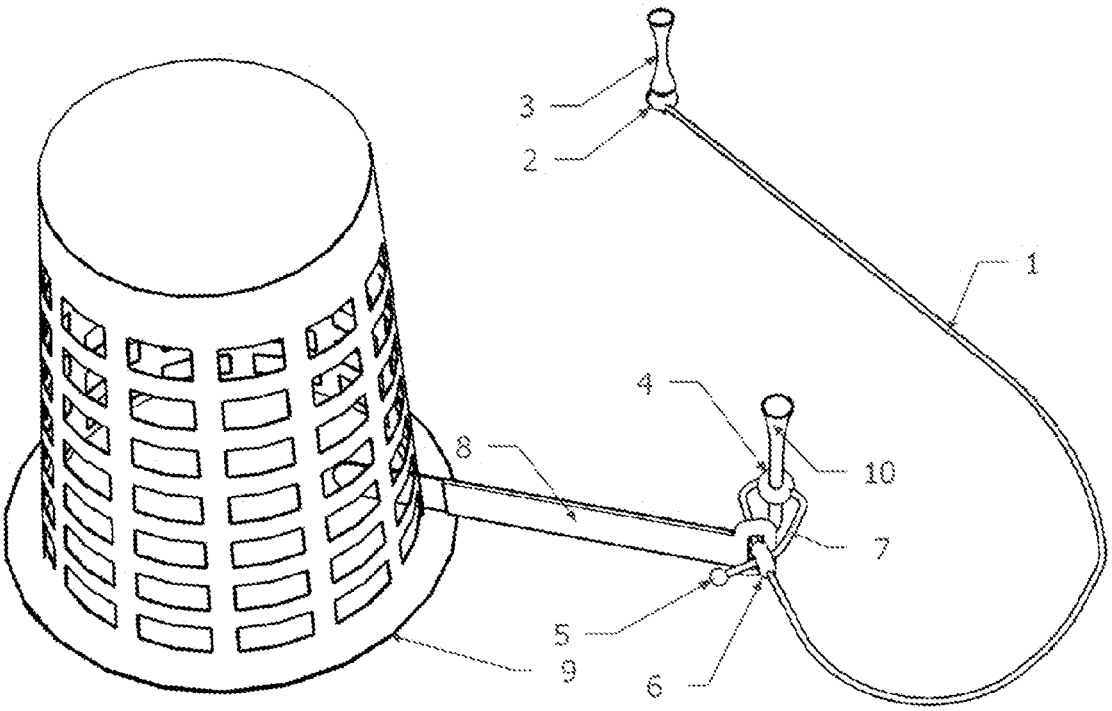
3
2
1
4
10
8
7
5
9
6

GOLF TEE AID

TECHNICAL FIELD

The invention belongs to the sports field and deals with a golf game and training aid, more precisely a golf tee aid that restricts the flight distance of the golf tee from the player during a tee shot.

PRIOR ART

From prior art there are devices that limit the flight range of the golf tee after a player strikes the golf ball, which are an elastic cord, one end of which is attached to the tee, while the other end is either permanently secured into the ground with a special anchoring device or fixed to a specialized weight.

Known devices are the "tee caddy," available at https://mygolfway.com/en/tee-caddy-great-invention-never-losing-tee/and GB2411123 (Given Paul Edward, published Aug. 24, 2005), designed to prevent the tee from flying off after the ball is hit. This tee aid consists of a flexible ring attached to the tee, and the flexible ring is connected to the anchoring device with a retractable wire or cord. After the golf ball is struck off the tee, the tee is rewound or pulled back to the striking position. The anchoring device is secured into the ground using a fork-shaped peg. This solution has the disadvantage of requiring anchoring into the ground, making it suitable only for hitting from natural grass surfaces, while artificial turf teeing areas do not provide the necessary substrate for anchoring, as there is typically a hard impermeable surface (concrete or similar) beneath the artificial turf, or the artificial turf mat itself is impermeable. Furthermore, the device's reliability is questionable, given its mechanical moving parts that can be affected by certain conditions such as rain or mud etc.

Another known solution is the anchored golf tee (U.S. Pat. No. 4,114,878, Hammond Robert Louis, published on Sep. 19, 1978). The golf tee is equipped with an anchor that is attached to the tee using a high-tensile strength flexible cord. The anchor has a disk with a fixing pin and a fastening device. The drawbacks of this solution are as follows: it only functions when hitting from natural grass, as it requires the anchor to be inserted deep into the ground, which also applies to the solution's accompanying complete golf tee set; it necessitates the use of a special golf tee provided in the set, which may not suit the players, and when it breaks (which often happens with tees), the solution's means are no longer usable; it potentially limits the use of different club lengths since in golf, balls are struck from varying heights, and the special golf tee provided in the set may not fully facilitate this. Typically, players, therefore, use tees of different lengths, which are inserted minimally into the ground to have minimal impact on the golf club's trajectory when the tee is struck.

The closest analogue in terms of technical nature is the golf tee anchor (GB2465342, Goss Stephen, published on May 19, 2010), which comprises a weight (anchor) to which one or more cords/strings are permanently attached at one end. At the other end(s) of the cord(s), there are fasteners that attach to the tee(s). The weight can have different shapes, and the fasteners can be flexible and/or elastic to attach to tees of different shapes and sizes. When the weight is used, the tees remain attached to the fasteners when struck with a golf club, preventing the tees from getting lost. The drawback of this solution is that the cords/strings are permanently attached to the weight (anchor) and must be carried at all times. Additionally, there are multiple cord/string attachments for different tees on the weight, which can be less convenient. Moreover, it can also be visually distracting to the golfer.

A common drawback among these technical solutions known from the prior art is that the second end of the connector (elastic cord) needs to be fastened either into the ground using a special tool or requires a portable weight (anchoring device) to which the connector is permanently attached. Additionally, these solutions usually require specialized golf tees to attach the connector. In the prior art there is no solution that is simultaneously functional with various commonly used tees, usable on both artificial turf and natural grass, and can be removably attached to a convenient separate weight.

BRIEF DESCRIPTION OF THE INVENTION

The purpose of the invention is to provide a golf tee aid that restricts the flight distance of the golf tee from the player after making a shot off the tee, which can be used with various commonly used tees, functions on both natural and artificial grass surfaces, and can be detachably attached to a convenient standalone weight.

To achieve this, a connector is provided, which is an elastic cord with a golf tee attachment loop at one end and two loops—an anchoring loop and a thickening loop—at the other end of the connector, with a thickening at the end of the connector. The anchoring loop is intended for anchoring using the tee and serving as an anchoring aid pushed into the ground. Using the thickening and thickening loop, a fastening device is created for the removable fastening aid. The removable fastening aid (can be a hook-and-loop strap, a carabiner hook, or a separate cord or string, among other options) is intended for attaching the connector to a weight that can be used as an anchoring device (being heavier object than the golf tee) and which is a standalone object from the fastening aid.

With the aid of the invention, it is possible to choose whether to use a separate tee as an anchoring device or some other convenient separate object that is heavier than a golf tee (such as a water bottle, a basket for golf balls, a leg of a golf club bag, etc.), or even both simultaneously.

The connector's golf tee attachment loop and anchoring loop are elastic and designed for use with commonly used tees of different lengths and thicknesses.

The elastic connector of the golf tee aid, together with the golf tee attachment loop, anchoring loop, thickening, and the fastening loop formed from these components, all of which are elastic, creates a comprehensive elastic solution allowing for the uniform distribution of tension, thereby enabling the use of both short-footed tees (det 3) and long-footed tees (det 10), which also vary in foot thickness.

LIST OF FIGURES

The FIGURE shows the golf tee aid with a standalone anchoring device.

EMBODIMENT OF THE INVENTION

The golf tee aid comprises a connector 1 in the form of an elastic cord between the golf tee 3 and a separate anchoring device 9 and/or the tee 10 used for anchoring.

One end of the connector 1 features a golf tee attachment loop 2 for attaching the connector 1 to the golf tee 3. The connector 1 is attached to the golf tee 3 in such a way that the tee is inserted into the golf tee attachment loop 2, and then the golf tee 3 is inserted into the ground (natural grass or artificial turf).

At the other end of the connector 1, there are two loops—an anchoring loop 4 and a thickening loop 6—with a thickening 5 at the end of the connector 1. The thickening 5 is inserted through the thickening loop 6 to form a fastening device 7 where the fastening aid 8 can be attached. The fastening aid 8 can be a hook-and-loop strap, a carabiner hook, or a separate cord or string, among other options. The fastening aid 8 is intended for attaching the connector 1 to a weight that serves as a standalone anchoring device 9. Fastening aid 8 is detachable from the connector 1 and the separate anchoring device 9. The standalone nature of the anchoring device means that it is not permanently attached to the connector 1, and it can be any external object (not part of the golf tee aid kit), such as a basket for golf balls, a stand for golf equipment bags, a water bottle, or another convenient item. The anchoring device 9 must be heavier than the golf tee 3.

Inside the fastening device 7, there is an anchoring loop 4 on the connector 1, intended for anchoring the tee 10 used for anchoring. The connector 1 is fastened to the tee 10 used for anchoring in such a way that the tee 10 used for anchoring is inserted through the anchoring loop 4 and then inserted into the ground (natural grass or artificial turf).

The Connector 1 is an Elastic Silicone Strap

The golf tee attachment loop 2 of the connector 1 and the anchor loop 4 are elastic, making them suitable for use with commonly used tees, including tees of different lengths and thicknesses (both for natural grass and artificial grass (flat-based) tees det 3 and det 10). The flat-based 1 can be used either with the separate anchoring tool 9 or with the anchoring tee 10, or with both simultaneously. For example, if there is no separate anchoring tool 9 with sufficient weight available, using the anchoring tee 10 provides additional anchoring.

The golf tee aid's elastic cord 1, along with the golf tee attachment loop 2, anchor loop 4, thickener 5 and thickener loop 6, and the resulting fastener 7, all of which are elastic, constitute a flexible and comprehensive solution that allows for even distribution of tensile force, enabling the use of both short tees (det 3) and long tees (det 10), which also come in various thicknesses.

The golf tee aid according to the invention is easy to carry and practical to use since it can be easily attached to a convenient separate object (anchoring object). This makes it especially comfortable for the user when practicing hitting golf balls off the tee, as the tee won't fly far from the player after the swing. Additionally, this aid can be used on artificial grass (flat-based tees).

LIST OF REFERENCES

1—connector
2—golf tee attachment loop
3—golf tee
4—anchor loop (fastener for the anchoring tool, which is another tee used as an anchor, referred to as the anchoring tee 10).
5—thickening
6—thickening loop (for inserting the thickening 5)
7—fastening device (for attaching the fastening aid 8)
8—fastening aid which is detachable
9—anchoring device with weight which is standalone device from connector 1
10—anchoring tee

The invention claimed is:

1. A golf tee aid comprising an elastic connector (1) between a golf tee (3) and a weight bearing anchoring device (9), the elastic connector (1) has, at one end, a golf tee attachment loop (2) for the golf tee (3), and at the other end of the elastic connector (1), there is an anchoring loop (4) for an anchoring tee (10), characterised in a way that:

at the anchoring tee (10) end of the elastic connector (1) is a thickening (5) and a thickening loop (6), wherein a fastening device (7) is formed by passing the thickening (5) through the thickening loop (6);

a fastening aid (8) being a book-and-loop strap or a carabiner hook is attached to the fastening device (7) for connecting the elastic connector (1) to a weight-bearing anchoring device (9);

the fastening aid (8) can be detached from the elastic connector (1) and the weight bearing anchoring device (9);

the weight bearing anchoring device (9) is a standalone object separate from the elastic cord (1) and the anchoring tee (10);

the golf tee attachment loop (2), the anchoring loop (4), the thickening (5), the thickening loop (6), and the fastening device (7) are all elastic; and the golf tee attachment loop (2) and the anchoring loop (4) are adaptable to tees of different lengths and thicknesses.

2. The golf tee aid according to claim 1, characterized in that the weight bearing anchoring device (9) and the anchoring tee (10) are used for anchoring.

3. The golf tee aid according to claim 1, characterized in that the weight-bearing anchoring device (9) is heavier than the golf tee (3).

* * * * *